US010823178B2

(12) United States Patent
Lesser et al.

(10) Patent No.: US 10,823,178 B2
(45) Date of Patent: Nov. 3, 2020

(54) RADIAL COMPRESSOR AND TURBORCHARGER

(71) Applicant: MAN ENERGY SOLUTIONS SE, Augsburg (DE)

(72) Inventors: Andreas Lesser, Munich (DE); Hannes Benetschik, Munich (DE); Christoph Heinz, Langenau (DE)

(73) Assignee: MAN Energy Solutions SE, Augsburg (DE)

( * ) Notice: Subject to any disclaimer, the term of this patent is extended or adjusted under 35 U.S.C. 154(b) by 121 days.

(21) Appl. No.: 16/198,190

(22) Filed: Nov. 21, 2018

(65) Prior Publication Data

US 2019/0162191 A1 May 30, 2019

(30) Foreign Application Priority Data

Nov. 24, 2017 (DE) ..... 10 2017 127 758

(51) Int. Cl.
*F04D 29/44* (2006.01)
*F04D 17/10* (2006.01)
*F04D 25/08* (2006.01)

(52) U.S. Cl.
CPC ..... *F04D 17/10* (2013.01); *F04D 25/08* (2013.01); *F04D 29/441* (2013.01); *F04D 29/444* (2013.01); *F05D 2220/40* (2013.01); *F05D 2250/52* (2013.01)

(58) Field of Classification Search
CPC ..... F04D 29/444; F04D 29/441; F04D 29/44; F04D 17/10; F04D 25/08; F05D 2250/52
See application file for complete search history.

(56) References Cited

U.S. PATENT DOCUMENTS 2,641,442 A * 6/1953 Buchi ..... F02C 6/12 415/191
5,529,457 A * 6/1996 Terasaki ..... F04D 29/444 415/208.3
6,168,375 B1 * 1/2001 LaRue ..... F04D 25/04 415/146
6,695,579 B2 * 2/2004 Meng ..... F04D 29/448 415/208.3
7,918,215 B2 * 4/2011 Martin ..... F01D 25/24 123/559.1
8,328,535 B2 * 12/2012 Anschel ..... F04D 29/444 417/407
8,545,177 B2 * 10/2013 Dettmann ..... F04D 29/441 415/203
9,086,002 B2 * 7/2015 Konig ..... F01D 1/06
(Continued)

FOREIGN PATENT DOCUMENTS

EP 1 340 920 9/2003
EP 2 194 277 6/2010

*Primary Examiner* — Kenneth J Hansen
*Assistant Examiner* — Behnoush Haghighian
(74) *Attorney, Agent, or Firm* — Cozen O'Connor

(57) ABSTRACT

A radial compressor, with a rotor-side impeller, a stator-side housing, an inflow passage via which medium to be compressed can be fed to the impeller in the axial direction, a diffuser via which compressed medium can be conducted in the radial direction away from the impeller in the direction of a spiral housing section of the housing The diffuser radially outside in a transition region to the spiral housing section has an enlarging flow cross section.

10 Claims, 1 Drawing Sheet

(56) References Cited

U.S. PATENT DOCUMENTS

| | | | | |
|---|---|---|---|---|
| 10,066,638 | B2 * | 9/2018 | Bessho | F04D 25/024 |
| 10,066,639 | B2 * | 9/2018 | Annati | F04D 17/06 |
| 10,280,936 | B2 * | 5/2019 | Yoeda | F01D 9/026 |
| 2002/0106278 | A1 * | 8/2002 | Koga | F04D 17/122<br>415/211.2 |
| 2007/0196206 | A1 * | 8/2007 | Martin | F04D 29/444<br>415/191 |
| 2007/0256412 | A1 * | 11/2007 | Martin | F01D 25/24<br>60/605.1 |
| 2012/0171030 | A1 * | 7/2012 | Iino | F04D 29/541<br>415/211.2 |
| 2016/0108920 | A1 * | 4/2016 | Yamashita | F04D 17/10<br>415/204 |
| 2016/0281734 | A1 * | 9/2016 | Musgrave | F04D 25/024 |
| 2020/0063753 | A1 * | 2/2020 | Higashimori | F04D 29/441 |

* cited by examiner

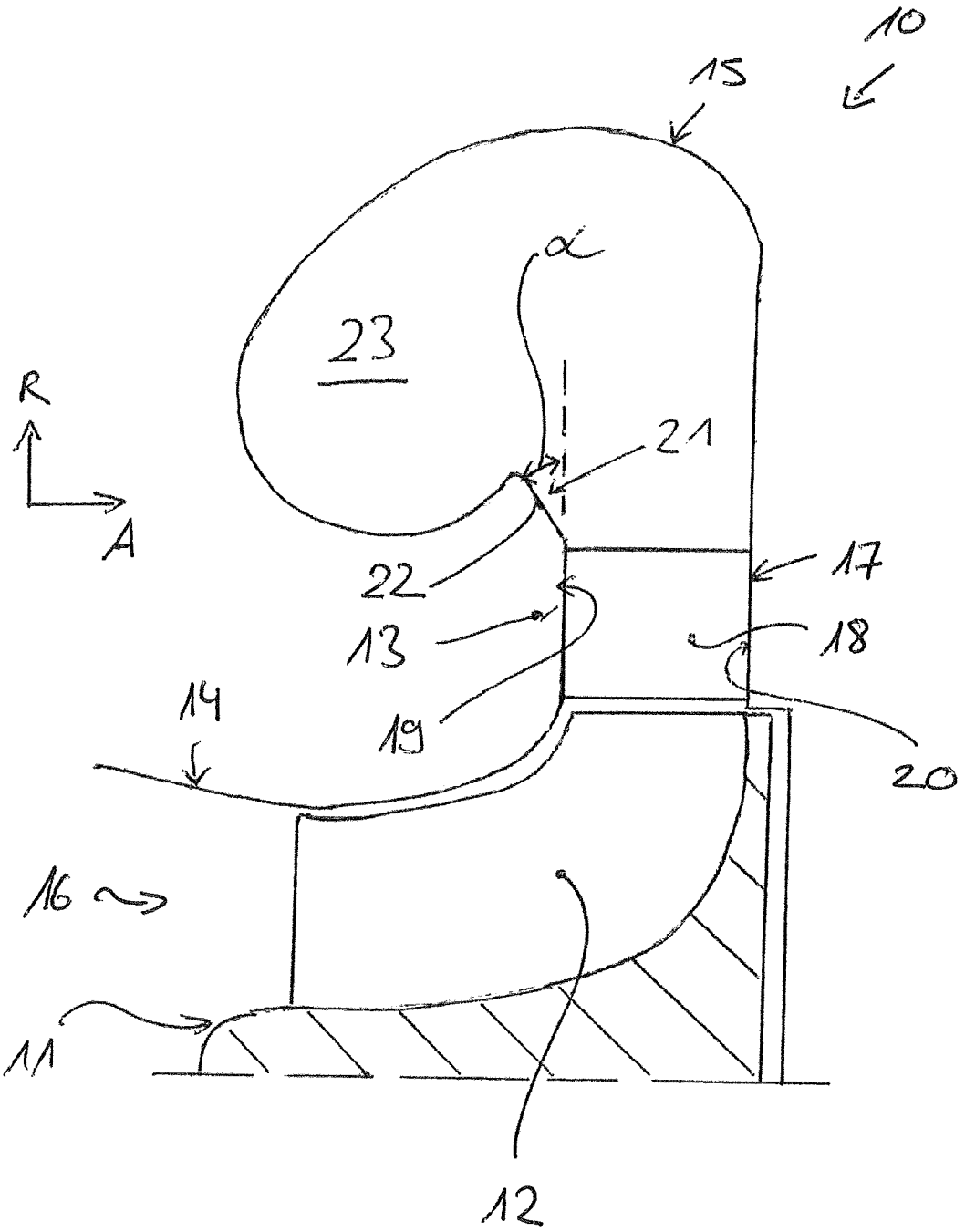
10
15
α
23
R
A
21
22
17
13
18
19
14
20
16
11
12

RADIAL COMPRESSOR AND TURBORCHARGER

BACKGROUND OF THE INVENTION

1. Field of the Invention

The invention relates to a radial compressor and a turbocharger with a radial compressor.

2. Description of the Related Art

From EP 1 340 920 B1 and EP 2 194 277 A1, a radial compressor of an exhaust gas turbocharger is known. Accordingly, this prior art shows a radial compressor with a rotor-side impeller, a stator-side housing, an inflow passage, via which medium to be compressed can be fed to the impeller in the axial direction, and a diffuser, via which compressed medium can be conducted away from the impeller in the radial direction and in the direction of a spiral housing section of the housing. According to EP 1 340 920 B1 and EP 2 194 277 A1 the diffusers are bladed diffusers comprising guide blades. Unbladed diffusers are also known.

SUMMARY OF THE INVENTION

There is a need for improving the efficiency of a radial compressor.

Starting out from this, one aspect of the invention is based on creating a new type of radial compressor.

According to one aspect of the invention, the diffuser has an enlarging flow cross section radially outside in a transition region to the spiral housing section.

Through the configuration of the diffuser in the transition region to the spiral housing section according to the invention, an improved filling-out of a so-called spiral plait start of the spiral housing section can be achieved. Ultimately, the efficiency of the radial compressor can be improved by this.

According to an advantageous further development, the diffuser is bounded by walls, which seen in the meridional section, are located axially opposite one another and extend in the radial direction, namely by a first wall that merges into a wall of the housing that bounds the inflow passage radially outside, and by a second wall, wherein on the first wall radially outside in the transition region to the spiral housing section a shoulder enlarging the flow cross section of the diffuser is formed. By way of this, the efficiency of the radial compressor can be particularly advantageously increased with simple design.

According to an advantageous further development, the shoulder is defined by a wall section which seen in the meridional section, is inclined relative to the first wall, which is inclined by a maximum angle of 45° relative to the first wall of the housing extending in the radial direction and/or which starts at 80% of the radial extension of the diffuser at the earliest. This further development also serves for increasing the efficiency of the radial compressor.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

The FIGURE is a schematized meridional section through a radial compressor according to the invention.

DETAILED DESCRIPTION OF THE PRESENTLY PREFERRED EMBODIMENTS

The FIGURE shows a cross section by way of an extract through a preferred exemplary embodiment of a radial compressor 10 according to one aspect of the invention.

A radial compressor 10 comprises a rotor-side impeller 11 with multiple moving blades 12.

Furthermore, radial compressor 10 comprises a stator-side housing 13. The stator-side housing 13 has a suction section 14, which seen in the flow direction of a medium to be compressed, is arranged upstream of the impeller 11 and a spiral housing section 15 arranged downstream of the impeller 11. The suction section 14 defines an inflow passage 16 at least in sections, via which medium to be compressed in the radial compressor 10 can be fed to the impeller 11 of the radial compressor 10 for compression.

Medium to be compressed in the region of the impeller 11 can be fed to the spiral housing section 15 via a stator-side diffuser 17 of the radial compressor 10. The exemplary embodiment of the FIGURE the diffuser 17 is formed as bladed diffuser with guide blades 18. Seen in the meridional section of the FIGURE, the medium to be compressed flows in the axial direction A through the inflow passage 16. The compressed medium flows in the radial direction R through the diffuser 17 in the direction of the spiral housing section 15. The spiral housing section 15 defines a spiral flow passage 23.

Seen in the meridional section, the diffuser 17, in the radial direction R, has an enlarging flow cross section in a transition region to the spiral housing section 15 and thus in the transition region to the spiral flow passage 23. By way of this, the filling of the so-called spiral plait start of the spiral flow passage 23 of the spiral housing 15 is improved, by way of which the efficiency of the radial compressor 10 is ultimately increased.

The spiral plait start of the spiral flow passage 23 of the spiral housing 15 is that circumferential section of the spiral flow passage 23, in which the same has the smallest flow cross section in the meridional section.

The diffuser 17 is bounded by walls 19, 20 extending in the radial direction R that, seen in the meridional section, lie opposite one another in the axial direction A, namely by a first wall 19, which merges into a wall of the housing 13 bounding the inflow passage 16 radially outside, namely of the suction section 14, and by a second wall 20, which is followed by a bearing housing of the turbocharger.

According to the FIGURE, a shoulder 21 enlarging the flow cross section of the diffuser 17 is formed on the first wall 19 radially outside in the transition region to the spiral housing section 15 and thus in the transition region to the spiral flow passage 23, which seen in the meridional section is defined by a wall section 22, which is inclined relative to the first wall 19.

The wall section 22 defining the shoulder 21 and thus the enlarging flow cross section of the diffuser 17 is inclined relative to the first wall 19 extending in the radial direction R by a maximum angle $\alpha$ of 45°.

Preferentially, the angle $\alpha$ is in a range between 45° and 10°, particularly preferably in an angular range between 45° and 20°.

The wall section 22 defining the shoulder 21 starts at 80% of the radial extension of the diffuser 17 at the earliest. In the case of a bladed diffuser 17 with guide blades 18, the shoulder 21 starts downstream of the guide blades 18 of the diffuser 17.

The shoulder 21 of the diffuser 17 and thus the enlarged flow cross section of the diffuser 17 are provided in the transition region to the spiral housing 13 and thus in the transition region to the spiral flow passage 23 at least in the region of the spiral plait start.

Preferentially, the shoulder 21 of the diffuser 17 and thus the enlarged flow cross section of the diffuser 17 runs around in the circumferential direction in the transition region to the spiral housing 13 and thus in the transition region to the spiral flow passage 23.

Furthermore, the invention relates to a turbocharger with such a radial compressor 10. The radial compressor 10 serves for compressing a medium, for example charge air, namely utilizing energy extracted in a turbine of the turbocharger during the expansion of another medium, for example exhaust gas. While the radial compressor comprises an impeller 11 and the housing 13, the turbine likewise comprises an impeller and a housing, but which are not shown in the FIGURE. The impeller 11 of the radial compressor 10 is coupled to the impeller of the turbine via a shaft mounted in a bearing housing of the turbocharger. The wall 20 of the diffuser 17 follows the bearing housing or is even provided by the bearing housing.

With the invention, the efficiency of a radial compressor 10 and thus also the efficiency of a turbocharger comprising the radial compressor 10 can be increased.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A radial compressor of a turbocharger, comprising: a rotor-side impeller; a stator-side housing having a spiral housing section; an inflow passage, via which a medium to be compressed can be fed to the rotor-side impeller in an axial direction; and a diffuser, via which compressed medium can be conducted in a radial direction away from the rotor-side impeller and towards the spiral housing section of the stator-side housing, the diffuser comprises guide blades having an input edge facing the rotor-side impeller and an output edge in a flow direction towards the spiral housing section, wherein an output portion of the diffuser is a passage that has a continuously enlarging flow cross section radially outside in a transition region to the spiral housing section that begins at the output edges of the guide blades and terminates at least in part in a spiral flow passage of the spiral housing section.

2. The radial compressor according to claim 1, wherein the diffuser is bounded by a first wall extending in the radial direction, which merges into a wall of the stator-side housing bounding the inflow passage radially outside, and by a second wall extending in the radial direction, which seen in a meridional section are located axially opposite one another.

3. The radial compressor according to claim 2, wherein on the first wall radially outside in the transition region to the spiral housing section a shoulder enlarging the flow cross section of the diffuser is formed.

4. The radial compressor according to claim 3, wherein the shoulder is defined by a wall section which seen in the meridional section is inclined relative to the first wall.

5. The radial compressor according to claim 4, wherein the wall section defining the shoulder is inclined relative to the first wall extending in the radial direction by a maximum angle of 45°.

6. The radial compressor according to claim 4, wherein the wall section defining the shoulder is inclined relative to the first wall extending in the radial direction by an angle between 45° and 10°.

7. The radial compressor according to claim 4, wherein the wall section defining the shoulder is inclined relative to the first wall extending in the radial direction by an angle between 45° and 20°.

8. The radial compressor according to claim 4, wherein the wall section defining the shoulder is formed downstream of the guide blades of the diffuser.

9. The radial compressor according to claim 3, wherein the wall section defining the shoulder starts at 80% of the radial extension of the diffuser at the earliest.

10. A turbocharger, comprising: a turbine for expanding a first medium; a radial compressor configured to compress a second medium utilising energy extracted during expansion of the first medium, comprising: a rotor-side impeller; a stator-side housing having a spiral housing section; an inflow passage, via which the second medium is fed to the rotor-side impeller in an axial direction; and a diffuser, via which compressed medium can be conducted in a radial direction away from the rotor-side impeller and towards the spiral housing section of the stator-side housing, the diffuser comprises guide blades having an input edge facing the rotor-side impeller and an output edge in a flow direction towards the spiral housing section, wherein an output portion of the diffuser is a passage that has a continuously enlarging flow cross section radially outside in a transition region to the spiral housing section that begins at the output edges of the guide blades and terminates at least in part in a spiral flow passage of the spiral housing section.

* * * * *